US005265336A

United States Patent [19]

Heintke

[11] Patent Number: 5,265,336

[45] Date of Patent: Nov. 30, 1993

[54] LONG-HAIR TRIMMING DEVICE FOR DRY SHAVING APPARATUS

[75] Inventor: Hans-Eberhard Heintke, Wächtersbach, Fed. Rep. of Germany

[73] Assignee: Braun Aktiengesellschaft, Fed. Rep. of Germany

[21] Appl. No.: 793,393

[22] PCT Filed: Jul. 4, 1990

[86] PCT No.: PCT/DE90/00502

§ 371 Date: Jan. 8, 1992

§ 102(e) Date: Jan. 8, 1992

[30] Foreign Application Priority Data

Jul. 28, 1989 [DE] Fed. Rep. of Germany ..... 3925006

[51] Int. Cl.[5] ..... B26B 19/06

[52] U.S. Cl. ..... 30/34.1; 30/223

[58] Field of Search ..... 30/34.1, 43.92, 90, 30/223

[56] References Cited

U.S. PATENT DOCUMENTS

| | | | |
|---|---|---|---|
| 4,118,863 | 10/1978 | Sandy | 30/223 |
| 4,233,733 | 11/1980 | Gallanis . | |
| 4,262,415 | 4/1981 | Braun | 30/34.1 |
| 4,274,199 | 6/1981 | Gallanis . | |
| 4,283,848 | 8/1981 | Aktiengesellschaft | 30/34.1 |
| 4,803,780 | 2/1989 | Locke et al. | 30/43.92 |
| 4,866,843 | 9/1989 | Kumano . | |
| 4,932,121 | 6/1990 | Jestadt et al. | 30/34.1 |

FOREIGN PATENT DOCUMENTS

| | | | |
|---|---|---|---|
| 201997 | 4/1970 | Fed. Rep. of Germany . | |
| 2137378 | 7/1971 | Fed. Rep. of Germany . | |
| 2836959 | 8/1978 | Fed. Rep. of Germany . | |
| 3031918 | 8/1980 | Fed. Rep. of Germany . | |
| 2199529 | 12/1987 | United Kingdom . | |
| 2040209 | 8/1989 | United Kingdom | 30/34.1 |

*Primary Examiner*—Hien H. Phan
*Assistant Examiner*—Paul M. Heyrana, Sr.
*Attorney, Agent, or Firm*—Fish & Richardson

[57] ABSTRACT

The invention is directed to a long-hair trimming device for dry shaving apparatus, with a stationary cutting comb provided with a bent flange on its rear side, with a toothed blade assembly capable of reciprocating longitudinally thereof in a rectilinear direction and urged there-against by means of springs, and with a spring mounting means fastened to the flange and providing the abutment for the springs, wherein the blade assembly is configured as a thin cutting blade mounted flat and fixedly on a supporting structure, wherein at least one angle lever cooperating with the springs is pivoted at the spring mounting means, the free lever arm extending in the direction of the supporting structure in the area of the teeth of the cutting blade and cooperating with the supporting structure under spring action, and wherein, next to the guide of the blade assembly directly on the inner surface of the flange further means for guiding the blade assembly are provided on the side of the spring mounting means proximate to the flange, which means include a sliding surface extending perpendicularly to the direction of working movement of the blade assembly and cooperating with the abutting sliding surface of corresponding means provided on the supporting structure of the blade assembly.

9 Claims, 1 Drawing Sheet

LONG-HAIR TRIMMING DEVICE FOR DRY SHAVING APPARATUS

Figure 1:
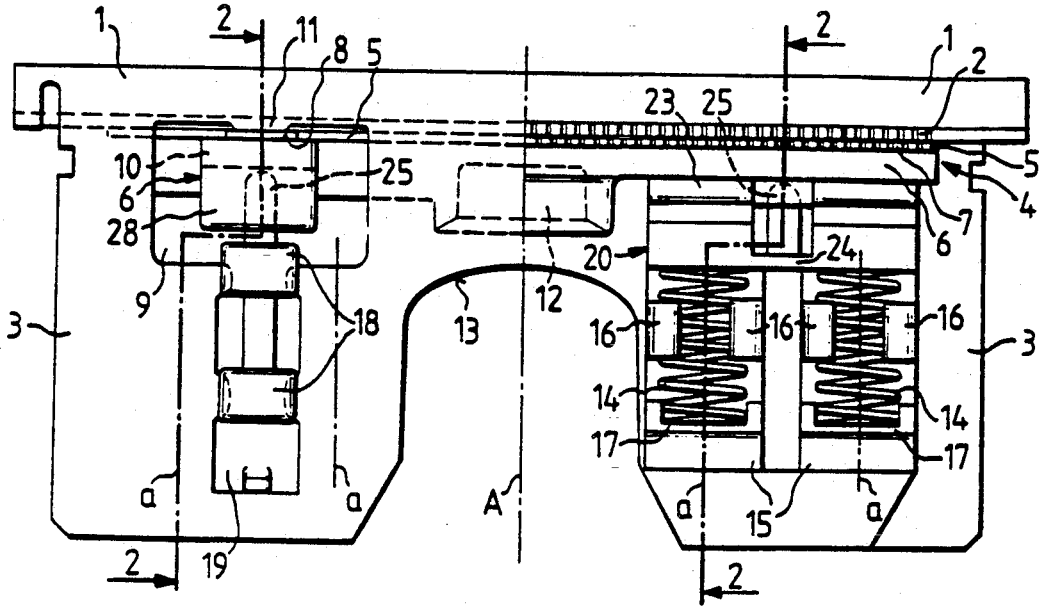

This invention relates to a long-hair trimming device for dry shaving apparatus, with a stationary cutting comb provided with a bent flange on its rear side, with a toothed blade assembly capable of reciprocating longitudinally thereof in a rectilinear direction and urged there-against by means of springs, and with a spring mounting means fastened to the flange and providing the abutment for the springs.

In the course of their development, long-hair trimming devices of this type which, for example, are known from German Pat. No. 2,019,978 have reached a high standard of engineering with regard to their function. Under the aspect of mass production, however, deficiencies were revealed which are suited to send up the manufacturing cost unnecessarily, in addition to adversely affecting the function of the long-hair trimming device. Thus, the device disclosed in the above-referenced literature necessitates an assembly in batches requiring the individual components to be introduced consecutively as on a string. This type of assembly is time-consuming, presenting an impediment to an automated assembly as aimed at nowadays for cost reasons. It is, therefore, an object of the present invention to provide a long-hair trimming device of the type referred to in the prior-art portion which, while providing a high standard of performance, requires only a small number of preassembly and final assembly steps, resulting in a further improvement of the economy of manufacture without impairing the function.

In the long-hair trimming device of the invention, preassembly involves no more than the step of inserting the springs in the spring mounting means, and final assembly is limited to the placement of the blade assembly into the angle of the cutting comb, followed by engagement of the knobs on the spring mounting means into the flange of the cutting comb. This knob engagement operation brings the blade assembly into its working position immediately, the teeth of comb and blade are urged against each other, and all possibilities of movement except the working movement are restricted, eliminating adverse effects that may be caused by manufacturing-related properties of components outside the assembly "long-hair trimming device" as, for example, tolerances of casing parts. The possibilities of an automated assembly are obvious.

While the use of a lever or the like for transmitting the spring force to the area proximate to the teeth of the blade assembly is in principle known from literature (German Pat. No. 2,836,959, U.S. Pat. No. 4,118,863), this is not the case with long-hair trimming devices of the type referred to in the prior-art portion and with a different special configuration; this idea alone is therefore not suited to accomplish the object of the invention.

Advantageously, the spring mounting means with their associated angle levers are integrally formed of plastic, and the joint between the two components is configured as a film hinge. Consequently, the spring mounting means occurs as a single component already in its manufacture and need not be assembled in a separate assembly operation as is the case, for example, in the device disclosed in U.S. Pat. No. 4,118,863.

An advantageous configuration of the rearward abutment provide the blade assembly at two locations, that is, on the flange of the cutting comb and on the spring mounting means, such that the locations, rather than relating to outside components as, for example, casing shells, relate only to components of the long-hair trimming device.

One embodiment of the present invention is illustrated in the accompanying drawing.

Figure 2:
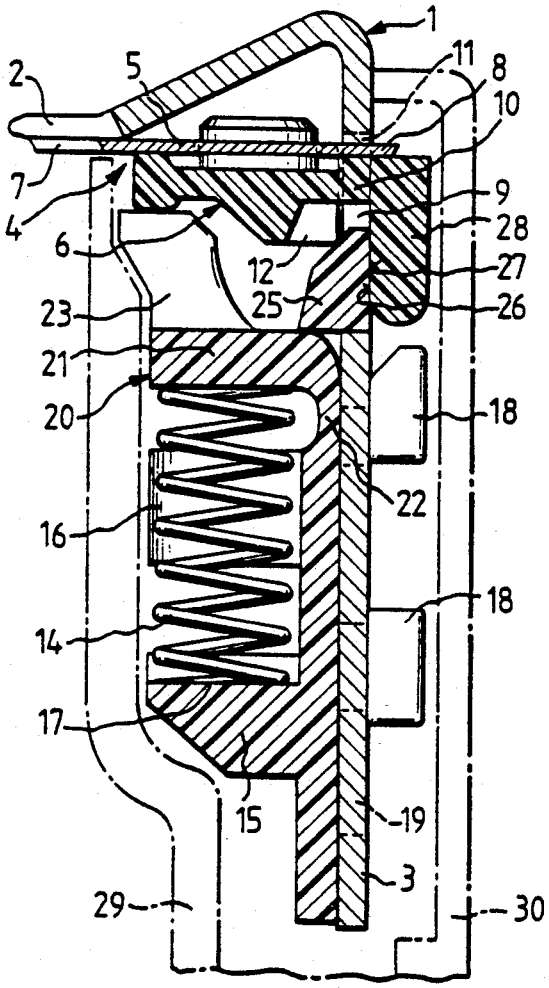

In the drawing,

FIG. 1 is a front view—right-hand part of the illustration—and a rear view—left-hand part of the illustration—of a long-hair trimming device for dry shaving apparatus; and FIG. 2 is a sectional view taken along the lines 2—2 of FIG. 1.

Referring to the drawing, and particularly to FIG. 1, the structure of the long-hair trimming device shown is in principle symmetrical to the center line A, comprising a cutting comb 1 which, for reasons of reinforcement, has the portion rearward of its teeth 2 first bent upwardly at an obtuse angle and subsequently bent downwardly at right angles—related to the cutting plane of the teeth 2—to form a flange 3, and further comprising a blade assembly 4 including a thin cutting blade 5 which is fixedly mounted on a supporting structure 6 and combines with it to form a flexurally rigid assembly. The cutting blade 5 has in its forward area teeth 7 which cooperate with the teeth 2 of the cutting comb 1, and has in its rearward area tangs 8 which, extending through a cutout 9 in the flange 3, rest with their one side on a shoulder 10 of the supporting structure 6 while their other side takes support upon a nose 11 on the upper edge of the cutout 9 in the flange 3. With its rearward edge, the blade assembly 4 rests with clearance against the inner surface of the flange 3 in the sections adjacent the tangs 8 and the shoulders 10, is thus slidably guided relative to the cutting comb 1 in the cutting plane in its forward and rearward area, and is secured against displacement both inwardly transversely to the direction of its working movement and vertically thereto.

As becomes apparent from FIG. 1, the supporting structure 6 of the blade assembly 4 includes, symmetrically to the center line A, a pocket 12 into which the head of a drive lever not shown in greater detail engages in a conventional manner; to ensure its freedom of motion, a suitable cutout 13 is provided in the flange 3.

To urge the blade assembly 4 into engagement with the cutting comb 1, springs 14 are provided—the spring axes being identified by reference a—which, grouped in pairs, are received in special spring mounting means 15 on either side of the line of symmetry or center line A and are held in cage-like fashion by means of integrally formed tangs 16 and abutments 17. Integrally formed with the rear side of the spring mounting means 15 are knobs 18 which are passed through a suitably dimensioned smaller area 19 of the flange cutout 9 for locking engagement therein, thus providing for positive and frictional locking engagement of the spring mounting means 15 with the flange 3.

Opposite to the spring abutments 17, two angle levers 20 are provided on the spring mounting means 15, each lever having an arm 21 which is pivoted at a film hinge 22 formed on the spring mounting means 15, and a free arm 23 thereof rests on or bears against the supporting structure 6 in the area of the teeth 7 of the cutting blade 5.

The spring 14 associated with each angle lever 20 produces a pivotal movement of the angle lever in clockwise direction (FIG. 2), so that the spring pressure is translated as a contact pressure of the teeth 7 of the blade assembly 4 against the teeth 2 of the cutting comb 1. Both angle levers 20 of a spring mounting means 15 are interconnected by an elastic link member 24. Formed on each spring mounting means 15 on its side proximate to the flange 3 is a bracket 25 which protrudes upwardly in the same direction as and parallel with and between the free arms 23 of the angle levers 20 (FIG. 2) and is dimensioned such that its rearward surface 26 extending through the cutout 9 in the flange 3 rests against an inner surface 27 of a trunnion 28 of the shoulder 10 on the supporting structure 6 of the blade assembly 4, the trunnion being bent downwardly at right angles (FIG. 2). The blade assembly 4 is thus secured through its supporting structure 6 on the spring mounting means 15 against displacement transversely to the direction of its working movement also in the direction of the teeth 7.

The long-hair trimming device is a self-contained functional unit which may be of a very slim configuration and allows pretesting in preassembled condition. In view of its small space requirements, not only is it permanently incorporable into the casing of a dry shaving apparatus, but can also be utilized advantageously with a slidable device employing two shallow casing shells 29 and 30 (FIG. 2).

I claim:

1. A long-hair trimming device for dry shaving apparatus comprising stationary cutting comb structure that includes a comb portion and a depending flange portion at the rear side of said comb portion, a plurality of springs, spring mounting structure fastened to said flange portion and providing abutment support for said springs, a blade assembly capable of reciprocating longitudinally of said comb structure in a rectilinear direction, said blade assembly including support structure and a thin cutting blade mounted flat and fixedly on said support structure, said blade having teeth along the front edge thereof, said support structure having a sliding surface at the rear edge of said blade and guide structure adjacent said sliding surface, lever structure cooperating with said springs and pivoted at said spring mounting structure, said lever structure including a free lever arm extending in the direction of said support structure in the area of the teeth of said cutting blade and cooperating with said support structure under biasing action of said springs, and lever guide structure mounted directly on the inner surface of said flange for guiding said blade assembly on the side of said spring mounting structure proximate to said flange, said lever guide structure including a sliding surface extending perpendicularly to the direction of working movement of said blade assembly and cooperating in sliding engagement with said sliding surface of said support structure of said blade assembly.

2. The long-hair trimming device of claim 1 wherein two identical spring mounting structures are provided on both sides of the center line (A) of the symmetrically structured long-hair trimming device.

3. The long-hair trimming device of claim 9 or 10 wherein said spring structure and its associated said lever structure are integrally formed of plastic, and said spring mounting structure and said lever structure are connected by a film hinge.

4. The long-hair trimming device of claim 1 or 2 wherein each said spring mounting structure is provided with two of said springs, and each said spring has a respective lever structure associated with.

5. The long-hair trimming device of claim 1 or 2 wherein said spring mounting structure is provided with two of said springs, and each said spring having a respective one of said lever structures associated therewith, and the free lever arms of said two lever structures of each said spring mounting structure are connected by a link member at their bases.

6. The long-hair trimming device of claim 1 or 2 wherein said guide structure associated with said spring mounting structure for guiding said blade assembly is of bracket configuration and protrudes upwardly parallel with and in the same direction as said free lever arm of said lever structure and extends through a cutout in said flange by such an amount such that said sliding surface of said lever structure lies approximately in the plane of a rear side of said flange, and that said corresponding guide structure associated with said support structure of the blade assembly is configured as a shoulder extending through said cutout in said flange and is provided with a downwardly bent trunnion engaging the rear side of said bracket, a sliding surface of said trunnion resting against the sliding surface of said lever guide structure.

7. The long-hair trimming device of claim 1 or 2 wherein said cutting blade has tang structure on its rear first side which rests with one side on shoulders of said support structure while its other side is supported on nose structure on the upper edge of a cutout in said flange.

8. The long-hair trimming device as claimed in claim 1 or 2 wherein the rear side of each spring mounting structure has integral knobs enabling it to be in positive and frictional locking engagement with cooperating portions of cutouts in said flange.

9. The long-hair trimming device of claim 6 wherein said cutting blade has tang structure on its rear first side which rests with one side on shoulders of said support structure while its other side is supported on nose structure on the upper edge of a cutout in said flange.

* * * * *

UNITED STATES PATENT AND TRADEMARK OFFICE

CERTIFICATE OF CORRECTION

PATENT NO. : 5,265,336

DATED : November 30, 1993

INVENTOR(S) : Hans-Eberhard Heintke

It is certified that error appears in the above-indentified patent and that said Letters Patent is hereby corrected as shown below:

Column 4, claim 3, line 7, "claim 9 or 10" should be -- claim 1 or 2--.

Signed and Sealed this

Seventeenth Day of May, 1994

*Attest:*

Bruce Lehman

BRUCE LEHMAN

*Attesting Officer*

*Commissioner of Patents and Trademarks*